US007028963B1

(12) United States Patent
Silva et al.

(10) Patent No.: US 7,028,963 B1
(45) Date of Patent: Apr. 18, 2006

(54) MAGNETIC MOUNTING BRACKET FOR CEILING FAN CANOPY

(75) Inventors: David Silva, Dallas, TX (US); Claire M. Gerhardt, Grand Prairie, TX (US)

(73) Assignee: Litex Industries, Limited, Grand Prairie, TX (US)

( * ) Notice: Subject to any disclaimer, the term of this patent is extended or adjusted under 35 U.S.C. 154(b) by 0 days.

(21) Appl. No.: 11/034,690

(22) Filed: Jan. 13, 2005

(51) Int. Cl.
*B42F 13/00* (2006.01)
*H05K 5/02* (2006.01)

(52) U.S. Cl. ..... 248/342; 248/343; 248/345

(58) Field of Classification Search ..... 248/342, 248/343, 344, 340, 345, 200.1, 206.5
See application file for complete search history.

(56) References Cited

U.S. PATENT DOCUMENTS

| | | | | |
|---|---|---|---|---|
| 1,270,296 | A * | 6/1918 | Jeune | 248/345 |
| 4,131,060 | A * | 12/1978 | Caine | 454/351 |
| 4,406,216 | A | 9/1983 | Hott et al. | |
| 5,613,832 | A * | 3/1997 | Su | 416/244 R |
| 5,947,436 | A | 9/1999 | Bucher et al. | |
| 6,042,072 | A * | 3/2000 | Chi-Nan | 248/343 |
| 6,171,061 | B1 * | 1/2001 | Hsu | 416/244 R |
| 6,171,062 | B1 * | 1/2001 | Bucher et al. | 416/244 R |
| 6,200,099 | B1 * | 3/2001 | Liao | 416/244 R |
| 6,280,145 | B1 * | 8/2001 | Liu | 416/244 R |
| 6,431,508 | B1 * | 8/2002 | Courson et al. | 248/205.3 |
| 6,644,617 | B1 | 11/2003 | Pitlor | |
| 6,733,239 | B1 | 5/2004 | Lee | |
| 6,877,703 | B1 * | 4/2005 | Tang | 248/342 |
| 2003/0189151 | A1 * | 10/2003 | Hsing | 248/345 |
| 2005/0006549 | A1 * | 1/2005 | Liu | 248/343 |

* cited by examiner

*Primary Examiner*—Anita King
*Assistant Examiner*—Tan Le
(74) *Attorney, Agent, or Firm*—Mark W. Handley; Chauza & Handley, L.L.P.

(57) ABSTRACT

A mounting bracket (30) for securing a ceiling fan (12) to a ceiling joist (10) has two mounting arms (68) and a support ring (60). The two mounting arms (68) are disposed on opposite sides of the support ring (60) and extend upward for securing to the ceiling joist (10). A down rod (34) of the ceiling fan (12) is suspended from the support ring (60). The two mounting arms (68) each have exteriorly face portions (25) into which respective recesses (58) are formed. Two magnets (56) are disposed interiorly within respective ones of the recesses (58). A ceiling fan canopy (28) has at least a portion thereof defined by a rim portion (21) which is made of a ferrous material. The canopy (28) is disposed around the mounting bracket (30) and the rim portion (21) is magnetically secured to the mounting bracket (30) by the two magnets (56).

17 Claims, 4 Drawing Sheets

MAGNETIC MOUNTING BRACKET FOR CEILING FAN CANOPY

INVENTOR(S)

David Silva, a resident of the City of Dallas, in Dallas County, Tex., United States of America, and a citizen of the United States of America and Claire M. Gerhardt, a resident of the City of Grand Prairie, in Dallas County, Tex., United States of America, a citizen of Germany.

TECHNICAL FIELD OF THE INVENTION

The present invention relates in general to ceiling fans, and in particular to ceiling mounting brackets and canopies for covering the ceiling fan mounting brackets.

BACKGROUND OF THE INVENTION

Prior art ceiling fans have been suspended from ceilings with mounting brackets which are fastened to a ceiling joists. Down rods extend from the mounting brackets, downward to the motors and motor housings of the ceiling fans. Upper ends of the down rods are secured to the mounting brackets, and the motors and motor housings of the ceiling fans are suspended from lower ends of the down rods. Canopies are typically provided by sleeves which extend around the down rods and cover the mounting brackets, such that the mounting brackets are concealed from view to enhance the appearance of the ceiling fans. Prior art canopies have been secured to mounting brackets by through-hole type threaded fasteners, such as screws, which extend through holes in the canopies and engage within threaded holes formed into the mounting brackets. The heads of the threaded fasteners are visible on the exteriors of the canopies, detracting from the visual appearance of the ceilings fans to which the canopies are mounted.

SUMMARY OF THE INVENTION

A mounting bracket for securing a ceiling fan to a ceiling joist has two mounting arms and a support ring. The two mounting arms are disposed on opposite sides of the support ring and extend upward for securing to the ceiling joist. A down rod of the ceiling fan is suspended from the support ring. The two mounting arms include two oppositely disposed tabs, each having exteriorly disposed end portions into which respective recesses are formed. Two magnets are disposed interiorly within respective ones of the recesses. A ceiling fan canopy has a tapered body and a rim portion which are made of a ferrous material. The canopy is quickly secured about the mounting bracket, without requiring hand tools, by first placing the canopy around the down rod during assembly of the down rod, and then placing the canopy over the mounting bracket with the rim portion of the canopy disposed adjacent to the two magnets to magnetically secured the canopy in position around the mounting bracket. In other embodiments, a canopy is mounted to a mounting bracket by threadingly engaging a rim portion of the canopy to outer face portions of the mounting bracket which are threaded. In yet another embodiment, a rim portion of a canopy has a flange with slots for fitting around exteriorly extending tab portions of mounting arms for a mounting bracket.

DESCRIPTION OF THE DRAWINGS

For a more complete understanding of the present invention and the advantages thereof, reference is now made to the following description taken in conjunction with the accompanying Drawings in which

FIG. 1 is a perspective view of a tear drop shaped ceiling fan having smooth exterior surfaces;

FIG. 2 is a partially exploded, cutaway view of the ceiling fan;

FIG. 3 is an exploded, perspective view of an upper portion of the ceiling fan, showing a mounting bracket, down rod and canopy cover for the ceiling fan;

FIG. 4 is a perspective view of the mounting bracket for the ceiling fan;

FIG. 5 is a perspective view of a first alternative mounting bracket and canopy for the ceiling fan, in which the mounting bracket has threaded exterior ends and the canopy has interior threads;

FIG. 6 is a perspective view of a second alternative mounting bracket and canopy for the ceiling fan, in which the mounting bracket has threaded outer ends and the canopy has molded interior threads;

FIG. 7 is a perspective view of a third alternative mounting bracket and canopy for the ceiling fan, in which the mounting bracket has threaded outer ends and a ring having interior threads is secured into the top of the canopy; and FIG. 8 is a perspective view of a fourth alternative mounting bracket and canopy for the ceiling fan, in which the canopy has an upper flange having two openings for passing outer ends of the mounting bracket.

Referring to the Figures, FIG. 1 is a perspective view of a tear drop shaped ceiling fan 12 mounted to a support member 10, such as a ceiling joist. The ceiling fan 12 has fan blades 16, which extend outward of a blade section sleeve 18 of the exterior housing 14. The exterior housing 14 includes the blade section 18, a finial section 20, a motor housing sleeve 22, a tapered sleeve 24, a down rod sleeve 26 and a mounting bracket canopy 28. The finial section 20 provides a lowermost portion of the exterior housing 14. The finial section 20, the blade section sleeve 18, the motor housing sleeve 22 and the tapered sleeve together provide an exterior surface 15 of the housing 14 with a teardrop shape. The down rod sleeve 26 is preferably of cylindrical shape and the mounting bracket canopy 28 is preferably a decorative sleeve which is downwardly tapered, being of a frusto-conical shape. The finial section 20, the canopy 28, and the sleeves 18, 22 and 24 together provide the exterior surface 15 of the housing 14 with a smoothly extending, contoured exterior shape, preferably without mounting holes or fasteners being visible, such as occurs with either through-hole type fasteners, which include rivets and threaded fasteners, including screws and bolts.

FIG. 2 is a partially exploded, cutaway view of the ceiling fan 12. The canopy 28 and a mounting bracket 30 are disposed at an upper end of a down rod 34. The mounting bracket canopy 28 preferably has a hollow body, with a tapered lower section 19 and an annular-shaped upper rim portion 21 defining an uppermost end of the canopy 28. The lower section 19 of the canopy 28 has a lower edge 23. The rim portion 21 provides a mounting portion of the canopy which is formed of ferrous material and which fits substantially flush against outwardly disposed end face portions 25 of the mounting bracket 30. Preferably, the entire canopy 28 is formed of ferrous material. An upward end of the down rod sleeve 26 has a first annular-shaped lip 29 which extends for fitting underneath a lower edge 23 of the mounting bracket canopy 28. An upper portion of the tapered sleeve 24 has a second annular-shaped lip 31 which extends for fitting underneath a downward end 33 of the down rod sleeve 26. The uppermost end of the motor housing sleeve 22 is formed to define a tongue 35 which fits underneath a lower portion 37 of the tapered sleeve 24. The lowermost end 39 of the motor housing sleeve 22 and an upwardly disposed portion 41 of the blade section sleeve 18 are spaced apart by a clearance space to allow rotation of the sleeve 18 relative to the sleeve 22. The outwardly disposed, upper edge 43 of the finial section 20 is spaced apart by a second clearance space from a downwardly disposed portion 45 of the blade section sleeve 18 to provide clearance for rotation of the blade section sleeve 18 relative to the finial section 20.

Figure 1:
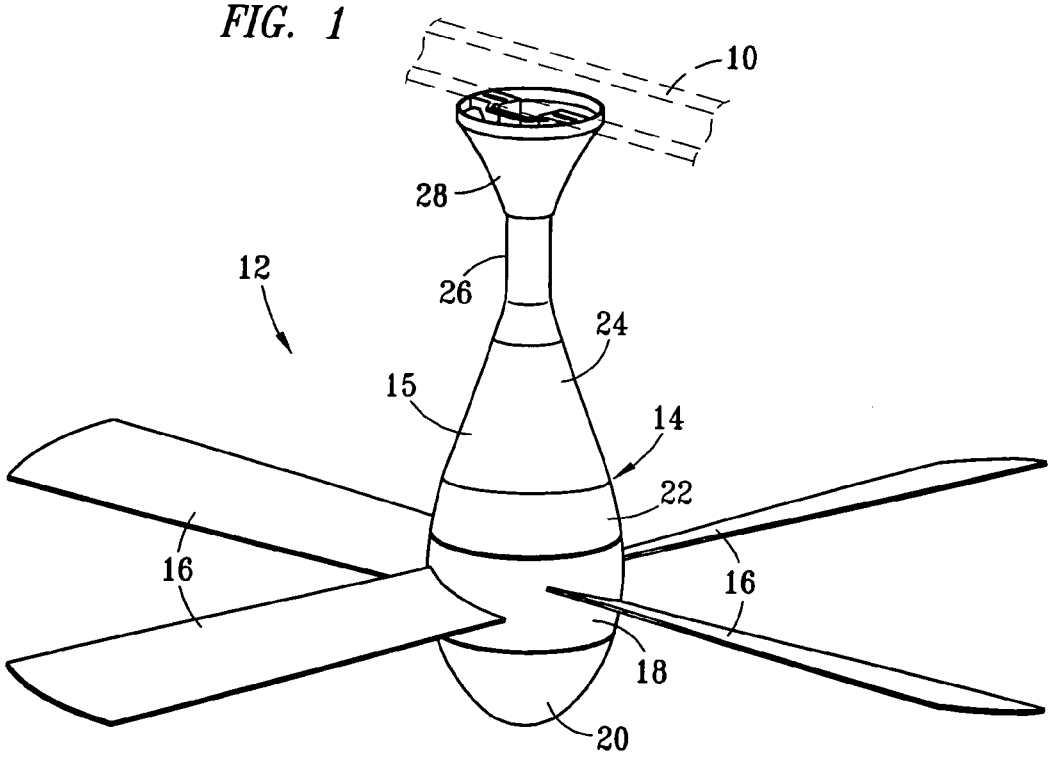
FIGS. 1 through 8 show various aspects for tear drop shaped ceiling fan having smooth exterior surfaces made according to the present invention, as set forth below.
Figure 2:
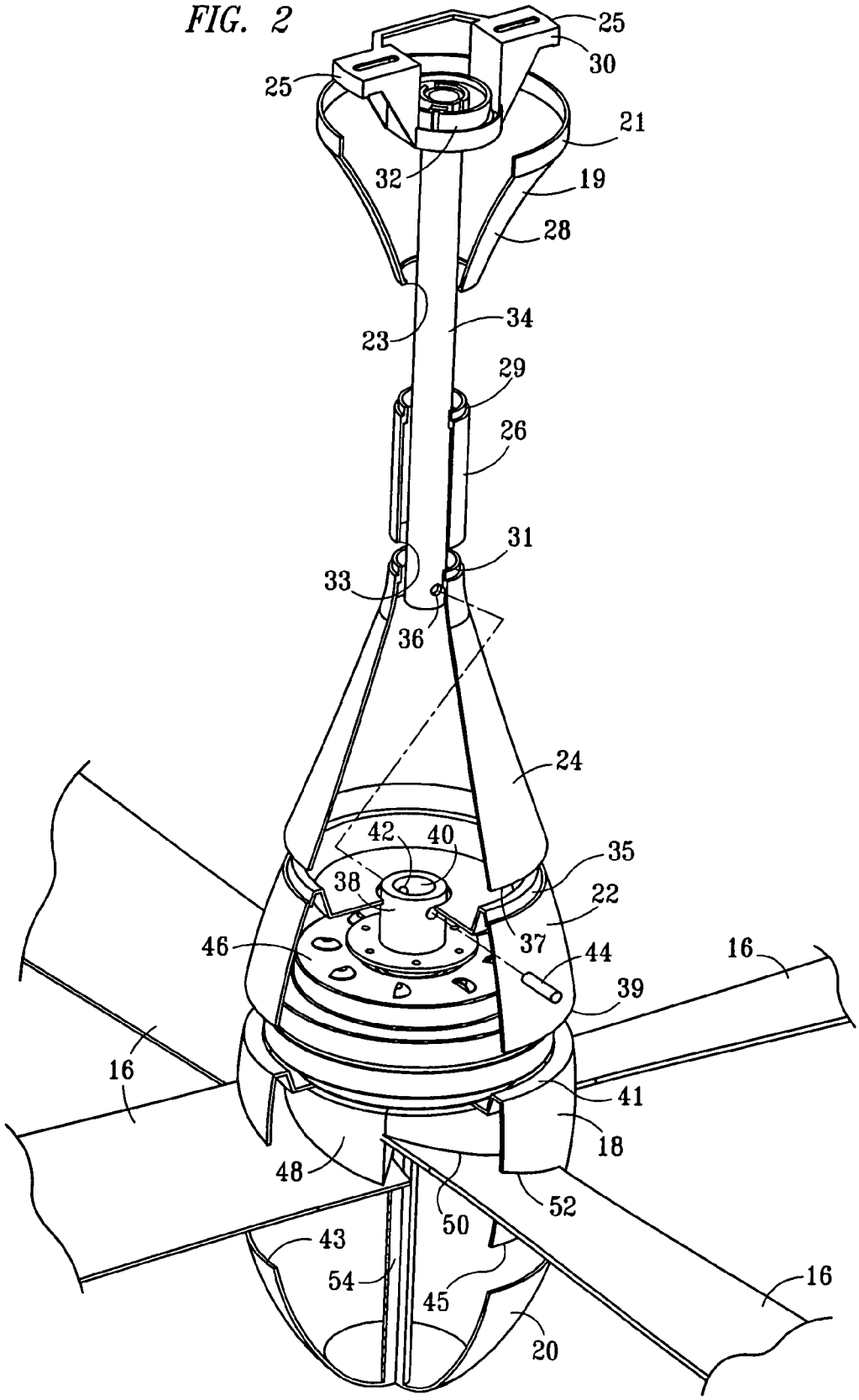

The mounting bracket 30 is provided for mounting to a support member 10 (shown in FIG. 1), such as a ceiling joist. An annular shaped mounting boss 32 is provided on the upper end of a down rod 34, and fits within a support ring 60 of the mounting bracket 30 to suspend the ceiling fan 12 from the mounting bracket 30. The down rod 34 is preferably a tubular member having a lower end through which two opposed apertures 36 extend for receiving a fastener pin 44. The lower end of the down rod 34 fits within an opening 40 in a yoke 38 for a fan motor 46. The yoke 38 has two oppositely disposed apertures 42 formed therein, with the apertures 42 located for aligning with the apertures 36 in the lower end of the down rod 34 for receiving the pin fastener pin 44. The stator portion of the fan motor 46 is fixedly secured to the mounting yoke 38, and the rotor portion of the fan motor 46 is secured to a fan blade mount 48. The mount 48 has mounting surfaces 50 against which flat end portions of the fan blades 16 are secured at an acute angle to a horizontal plane. The blade section sleeve 18 is preferably secured to an upper end of the fan blade mount 48, and has slots 52 formed therein for the blades 16 to extend through. The slots 52 for passing the fan blades 16 through the blade section sleeve 18 are preferably formed with longitudinal axes which extend parallel to the plane of the flat end portions of the fan blades 16. A finial rod 54 extends from the lower end of the finial section 20 to secure the finial section 20 to the fan motor 46. In the preferred embodiment of the ceiling fan 12, the finial rod 54 is secured to the stator portion of the motor 46, such that the finial section 20 is stationary and does not turn with the blades 16.

Figure 3:
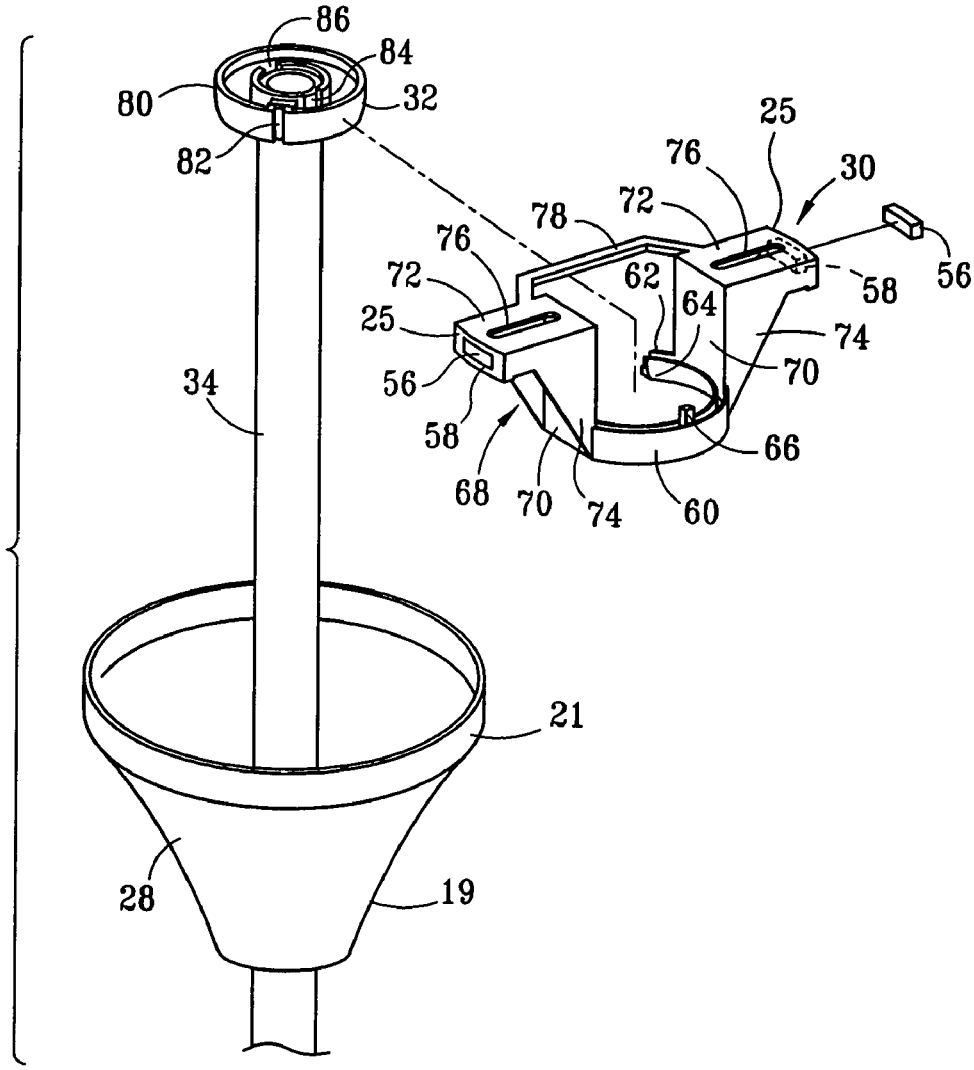

FIG. 3 is an exploded, perspective view of an upper portion of the ceiling fan 12, showing assembly of the down rod 34 and the mounting bracket canopy 28 prior to assembly to the mounting bracket 30. The mounting bracket 30 preferably has two magnets 56 which fit into the end face portions 25 of opposite sides of the mounting bracket 30, inserting into openings provided by the recesses 58. The mounting bracket canopy 28 is preferably formed of ferrous materials, such that the canopy 28 is disposed adjacent the mounting bracket 20, preferably flush with the recesses 58, and is magnetically held in place around the mounting bracket 30 by the two magnets 56. The mounting bracket 30 is preferably provided by a casting, having the support ring 60 which extends between two mounting arms 68 to provide a support member for the mounting bracket 30. The support ring 60 is preferably an annular shaped ring which is not a continuous ring, but rather has two ends 62 defining an opening in the support ring 60 for passing the down rod 34 during assembly of the down rod 34 to the mounting bracket 30. The support ring 60 preferably has an interior surface 64 which is tapered to have circumferential diameters which are larger at the top and smaller at the bottom. The boss 32 of the down rod 34 will nest within the support ring 60. A locating tab 66 extends upward from the support ring 60 for fitting in the slot 82 in the boss 32 for angularly locating the mounting boss 32 of upper end of the down rod 34 with the mounting bracket 30.

The two mounting arms 68 of the mounting bracket 30 preferably have vertical portions 70 and tab portions 72, each having planar surfaces. Gusset supports 74 extend between respective ones of the vertical portions 70 and tab portions 72, and also have planar surfaces. The upper surfaces of the tab portions 72 are flat and have slots 76 formed therein which provide mounting apertures for securing the mounting bracket 30 to the ceiling support member 10, such as a ceiling joist (shown in FIG. 1). A support arm 78 extends between the two mounting arms 68, adjacent to the upper surfaces of the tab portions 72. The outermost end portions of the tabs 72 define the end face portions 25, which face in opposite directions. The end face portions 25 and are preferably defined by edges of the vertical portions 70 and the tab portions 72, with the vertical portions 70 and the tab portions 72 being defined by planar surfaces, and the mounting recesses 58 define there-between. A lower surface is preferably provided for the recesses 58 by a planar member. In other embodiments, the end face portions 25 may be solid members into which the mounting recesses 58 are formed. The mounting recesses 58 are configured for receiving the magnets 56. The magnets 56 are preferably provided by bar magnets. The upper end 84 of the down rod 34 is secured within a yoke 86 of the mounting boss 32. The mounting boss 32 has an exterior surface 80 having a slot 82 for receiving the locating tab 66. The surface 80 is adapted for fitting within the surface 64 of the support ring 60, and is preferably tapered for fitting flush with the surface 64 of the support ring 60.

The upper end 84 of the down rod 34 is secured within an yoke 86 of the mounting boss 32. The mounting boss 32 has an exterior surface 80 having a slot 82 for receiving the locating tab 66. The surface 80 is adapted for fitting within the surface 64 of the support ring 60, and is preferably tapered for fitting flush with the surface 64 of the support ring 60.

Figure 4:
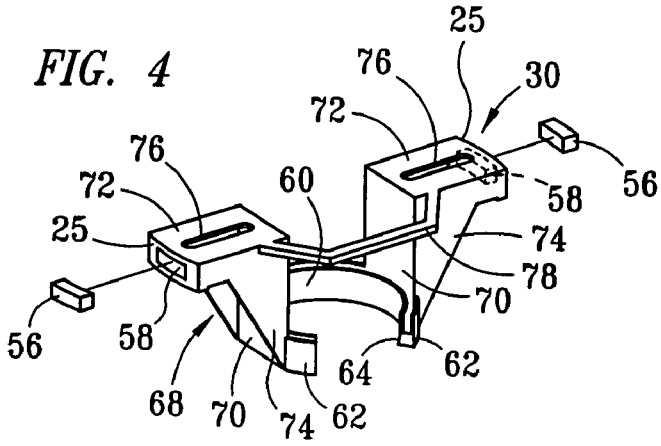

FIG. 4 is a perspective view showing an opposite side of the mounting bracket 30 from that shown in FIG. 3. The opening between the two ends 62 of the support ring 60 are more clearly seen. The two ends 62 are spaced apart and the down rod 34 is sized for fitting the down rod 34 between the two ends 62, with the boss 32 disposed between the support ring 60 and the support arm 78.

Figure 5:
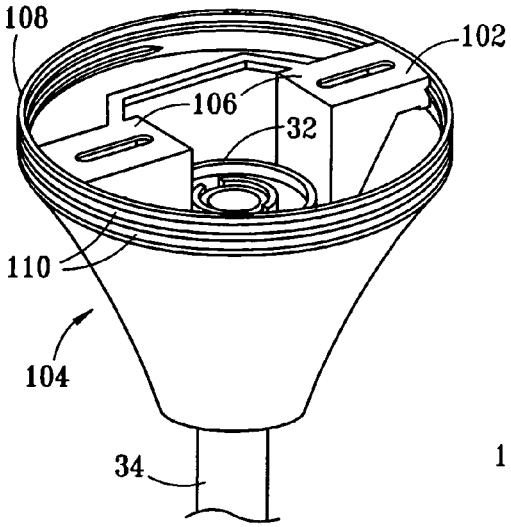

FIG. 5 is a perspective view of a first alternative mounting bracket 102 and an alternative canopy 104. The mounting bracket 102 is similar to the mounting bracket 30, except that the outward end portions of the tabs 106 are threaded with coarse threads. The annular shaped rim portion 108 of the canopy 104 is threaded, preferably by roll forming the threads 110 into the canopy 104. The down rod 34 and the boss 32 will fit within the mounting bracket 102, as described above in reference to the mounting bracket 30. The canopy 104 is secured to the threaded outward end portions of the tabs 106 by rotating the canopy 104 relative to the mounting bracket 102, in accordance to an angular direction determined by whether the threads 110 are right-hand or left-hand threads.

Figure 6:
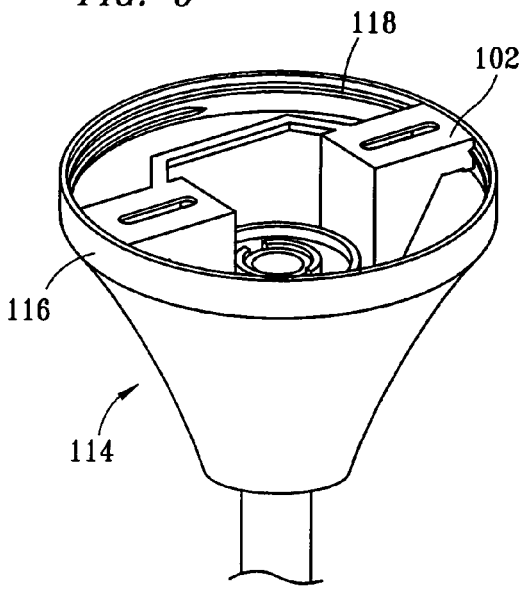

FIG. 6 is a perspective view of the mounting bracket 102 and an alternative canopy 114 for a ceiling fan. An annular shaped rim portion 116 of the canopy 114 is threaded, preferably by molding the threads 118 into the annular shaped upper end 116. The canopy 114 is preferably formed of a molded material. The canopy 114 is secured to the threaded outward end portions of the tabs 106 by rotating the canopy 114 relative to the mounting bracket 102, in accordance to an angular direction determined by whether the threads 118 are right-hand or left-hand threads.

Figure 7:
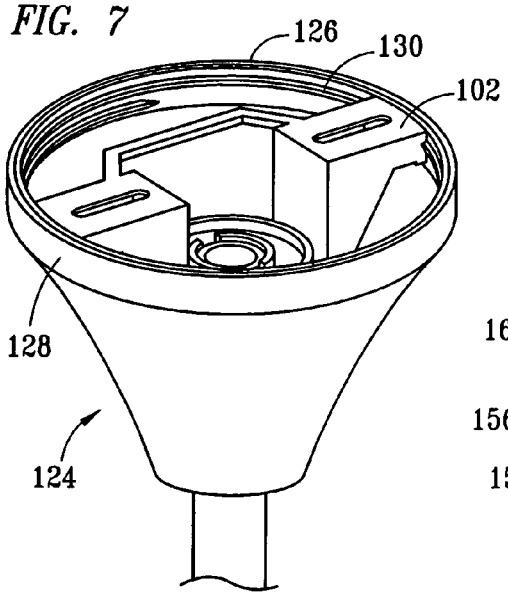

FIG. 7 is a perspective view of the alternative mounting bracket 102 and an alternative canopy 124 for securing to the threaded outward end portions of the mounting bracket 102. A threaded ring 126 is installed within the annular shaped rim portion 128 of the canopy 124. The threaded ring 126 may be of a light weight material into which the threads 130 are roll formed, or of a machinable material into which the threads 130 are machined, or of a material which is molded to provide the ring 126 and the threads 130. The threaded ring 126 may be press fit into the rim portion 128 of the canopy 124, or secured by adhesives, or by means of mechanical fasteners, and the like. The canopy 124 is secured to the threaded outward end portions of the tabs 106 by rotating the canopy 124 relative to the mounting bracket 102 in accordance to an angular direction determined by whether the threads 130 are right-hand or left-hand threads.

Figure 8:
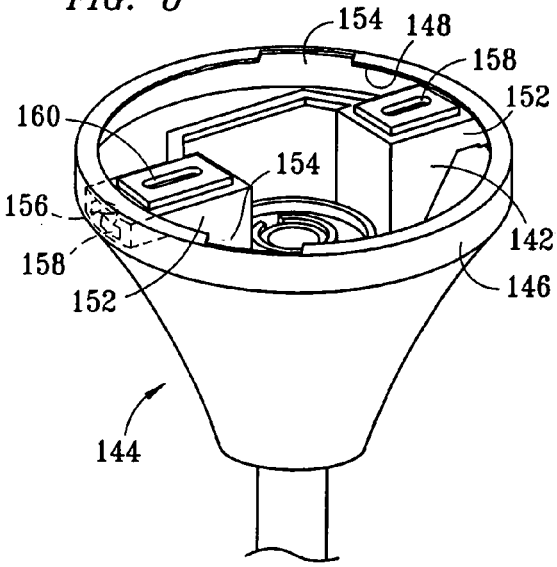

FIG. 8 is a perspective view of a second alternative mounting bracket 142 and a canopy 144 for securing to the mounting bracket 142. A rim portion 146 of the canopy 144 has a flange 148 at the uppermost terminal end thereof. Two openings 154 are provided by slots formed into the flange 148 for passing the outward ends of the two tabs 152 of the mounting bracket 142, and turning the canopy 144 to place the tabs 152 beneath the flange 148 to secure the canopy 144 about the mounting bracket 142. The rim portion 146 of the canopy 144 may also include internally disposed snap detent members 156, such as leaf springs, which fit into recesses 158 formed into the outward edge faces of the tabs 152 of the mounting bracket 142, similar to the recesses 58 formed into the mounting bracket 30. The mounting bracket 142 is configured similar to the mounting bracket 30, for receiving the boss 32 and the down rod 34. Raised bosses 158 and 160 are provided on the upper sides of respective ones of the tabs 152 to provide a spacer between the tabs 152 and the support member 10 (shown in FIG. 1) for the flange 148, such that the bosses 158 and 160 fit flush against the support member 10.

Thus the advantages of this invention provide a decorative canopy for concealing a mounting bracket which is fastened to a ceiling and suspends a ceiling fan from the ceiling, without through-hole type fasteners being visible from the exterior of the canopy. The canopy is quickly secured about the mounting bracket, without requiring hand tools. In a preferred embodiment, the canopy has a ferrous rim portion which is magnetically secured in position around the mounting bracket. In other embodiments, a canopy is mounted to a mounting bracket by threadingly engaging a rim portion of the canopy to outer face portions of the mounting bracket. In yet another embodiment, a rim portion of a canopy has a flange with slots for fitting around exteriorly extending tab portions of mounting arms for a mounting bracket.

Although the preferred embodiment has been described in detail, it should be understood that various changes, substitutions and alterations can be made therein without departing from the spirit and scope of the invention as defined by the appended claims.

What is claimed is:

1. An apparatus for securing a ceiling fan canopy to a ceiling fan, the apparatus comprising:

a mounting bracket having a support member and at least two mounting tabs, said mounting tabs spaced apart around said support member and having apertures for securing said mounting bracket to a ceiling support member;

a down rod having an upper end and a lower end, wherein said upper end is secured to said support member of said mounting bracket and said lower end is adapted to be secured to a motor of the ceiling fan;

a canopy having a hollow body with a lower portion and a rim portion, said hollow body adapted for enclosing said mounting bracket, said lower portion being adapted for receiving said down rod, and said rim portion adapted for fitting adjacent to said mounting bracket;

said mounting tabs of said mounting bracket have end face portions into which at least one recess is formed for receiving said at least one magnet, such that said canopy is magnetically secured to said mounting bracket when said rim portion of said canopy is disposed adjacent to said end face portions;

at least one magnet secured to said mounting bracket; and wherein at least part of said rim portion of said canopy is formed of ferrous materials, such that said at least one magnet is disposed relative to said mounting bracket to magnetically secure said canopy in position around said mounting bracket.

2. The apparatus for securing a ceiling fan canopy to a ceiling fan according to claim 1, wherein said rim portion of said canopy is formed of ferrous material and said mounting tabs of said mounting bracket have end face portions into which at least one recess is formed for receiving said at least one magnet, such that said canopy is magnetically secured to said mounting bracket when said rim portion of said canopy is disposed adjacent to said end face portions.

3. The apparatus for securing a ceiling fan canopy to a ceiling fan according to claim 2, wherein said mounting bracket has two mounting arms and said support member is defined by a support ring, said two mounting arms are disposed on opposite sides of said support ring and extend upward at right angles to a circumference of said support ring.

4. The apparatus for securing a ceiling fan canopy to a ceiling fan according to claim 1, wherein lower portion of said hollow body of said canopy is tapered, such that said lower portion is of smaller size than said rim portion of said canopy.

5. The apparatus for securing a ceiling fan canopy to a ceiling fan according to claim 1, wherein said at least one magnet is a bar magnet.

6. The apparatus for securing a ceiling fan canopy to a ceiling fan according to claim 1, wherein said entire canopy is formed ferrous materials.

7. The apparatus for securing a ceiling fan canopy to a ceiling fan according to claim 1, further comprising:

said rim portion of said canopy being formed of ferrous material;

wherein said support member is defined by a support ring, said mounting bracket having two mounting arms, wherein said two mounting arms are disposed on opposite sides of said support ring and extend upward at right angles to a circumference of said support ring, and said two mounting arms each having said end face portions into which at least said one interiorly extending recess is formed for receiving said at least one magnet; and wherein said hollow body of said canopy is disposed around said down rod and said mounting bracket, with said down rod extending through said lower portion of said canopy and said rim portion disposed adjacent to said at least one magnet to magnetically secure said canopy to said mounting bracket.

8. The apparatus for securing a ceiling fan canopy to a ceiling fan according to claim 7, wherein said at least one magnet is a bar magnet.

9. An apparatus for securing a ceiling fan canopy to a ceiling fan, the apparatus comprising:

a mounting bracket having a support ring and at least two mounting tabs, said mounting tabs spaced apart around said support ring and having apertures for securing said mounting bracket to a ceiling support member, said mounting tabs having outwardly disposed ends which define face portions, each of said face portions having a recess formed therein;

at least two magnets disposed interiorly within respective ones of said recesses in said face portions of said mounting tabs of said mounting bracket;

a down rod having an upper end and a lower end, wherein said upper end of said down rod has a boss by which said down rod is suspended from said support ring of said mounting bracket, and said lower end of said down rod is adapted for securing to a motor of ceiling fan;

a canopy having a hollow body with a lower portion and a rim portion, said hollow body adapted for enclosing said mounting bracket, said lower portion adapted for receiving said down rod, and said rim portion adapted for fitting adjacent to said face portions of said mounting bracket; and wherein at least said rim portion of said canopy is formed of ferrous material, such that said canopy is magnetically secured in position around said mounting bracket when said rim portion is disposed adjacent said at least two magnets with said hollow body enclosing said mounting bracket.

10. The apparatus for securing a ceiling fan canopy to a ceiling fan according to claim 9, wherein said support ring of said mounting bracket is of annular shape, and said mounting bracket includes two mounting arms, each of said mounting arms having lower portions which extend from opposite sides of said support ring, and upper portions which define said mounting tabs of said mounting bracket, and a support arm which extends between upper portions of said two mounting arms, said support ring having two ends which are separated to define an opening in said support ring, wherein said opening in said support ring and said support arm are disposed on one side of said mounting arms.

11. The apparatus for securing a ceiling fan canopy to a ceiling fan according to claim 9, wherein said two magnets are bar magnets.

12. The apparatus for securing a ceiling fan canopy to a ceiling fan according to claim 9, wherein said entire canopy is formed of ferrous materials.

13. The apparatus for securing a ceiling fan canopy to a ceiling fan according to claim 9, wherein said support ring of said mounting bracket is of annular shape, and said mounting bracket includes two mounting arms, each of said mounting arms having lower portions which extend from opposite sides of said support ring, and upper portions which define said mounting tabs of said mounting bracket, and a support arm which extends between upper portions of said two mounting arms, said support ring having two ends which are separated to define an opening in said support ring, wherein said opening in said support ring and said support arm are disposed on one side of said mounting arm;

wherein said hollow body of said canopy is tapered, with said lower portion of said canopy having a smaller diameter than said rim portion;

wherein said two magnets are bar magnets; and wherein said entire canopy is formed of ferrous materials.

14. An apparatus for securing a ceiling fan canopy to a ceiling fan, the apparatus comprising:

a mounting bracket having a support ring which is of annular shape, two mounting arms having lower portions which extend from opposite sides of said support ring, and a support arm which extends between upper portions of said two mounting arms, said support ring having two ends which are separated to define an opening in said support ring, wherein said opening in said support ring and said support arm are disposed on one side of said mounting arms, said mounting arms having gusset portions and tab portions, said tab portions defining said upper portions of said two mounting arms and each having a respective mounting aperture extending through said tab portions;

said tab portions defining two oppositely facing, exteriorly disposed face portions;

two recesses disposed at said face portions of said tabs, said two recessed defined to interiorly extend within respective ones of said tabs of said two mounting arms, and two magnets disposed interiorly within respective ones of said recesses;

a down rod having an upper end and a lower end, wherein said upper end of said down rod has a boss by which said down rod is suspended from said support ring of said mounting bracket, and said lower end of said down rod is adapted for securing to a motor of the ceiling fan;

a ceiling fan canopy having a hollow body for enclosing said mounting bracket, said hollow body having a lower portion and a rim portion, said lower portion adapted for receiving said down rod, and said rim portion adapted for receiving said mounting bracket; and said rim portion of said canopy, being formed of ferrous material, such that said canopy is disposed around said mounting bracket with said rim portion disposed adjacent to said two magnets to magnetically secure said canopy in position about said mounting bracket by said two magnets, wherein said rim portion engages with said two magnets to secure said canopy in a fixed position relative to said two mounting arms of said mounting bracket.

15. The apparatus for securing a ceiling fan canopy to a ceiling fan according to claim 14, wherein said magnets are bar magnets, and wherein said entire canopy is formed ferrous materials.

16. An apparatus for securing a ceiling fan canopy to a ceiling fan, the apparatus comprising:

a mounting bracket having a support ring which is of annular shape, two mounting arms having lower portions which extend from opposite sides of said support ring, and a support arm which extends between upper portions of said two mounting arms, said support ring having two ends which are separated to define an opening in said support ring, wherein said opening in said support ring and said support arm are disposed on one side of said mounting arms, said mounting arms having gusset portions and tab portions, said tab portions defining said upper portions of said two mounting arms and each having a respective mounting aperture extending through said tab portions;

said tab portions defining two oppositely facing, exteriorly disposed face portions;

first threads formed on said face portions of said tab portions of said mounting bracket;

a down rod having an upper end and a lower end, wherein said upper end of said down rod has a boss by which said down rod is suspended from said support ring of said mounting bracket, and said lower end of said down rod is adapted for securing to a motor of the ceiling fan;

a ceiling fan canopy having a hollow body for enclosing said mounting bracket, said hollow body having a lower portion and a rim portion, said lower portion adapted for receiving said down rod, and said rim portion adapted for receiving said mounting bracket;

second threads defined by said rim portion of said canopy, wherein said second threads matingly engage with said first threads in said tab portions of said mounting bracket to secure said canopy in a fixed position relative to said two mounting arms of said mounting bracket; and wherein said second threads are formed into a ring which is separately formed from said canopy, and said ring is secured to said rim portion of said canopy.

17. An apparatus for securing a ceiling fan canopy to a ceiling fan, the apparatus comprising:

a mounting bracket having a support ring which is of annular shape, two mounting arms having lower portions which extend from opposite sides of said support ring, and a support arm which extends between upper portions of said two mounting arms, said support ring having two ends which are separated to define an opening in said support ring, wherein said opening in said support ring and said support arm are disposed on one side of said mounting arms, said mounting arms having gusset portions and tab portions, said tab portions defining said upper portions of said two mounting arms and each having a respective mounting aperture extending through said tab portions;

said tab portions defining two oppositely facing, exteriorly disposed face portions;

a down rod having an upper end and a lower end, wherein said upper end of said down rod has a boss by which said down rod is suspended from said support ring of said mounting bracket, and said lower end of said down rod is adapted for securing to a motor of the ceiling fan;

a ceiling fan canopy having a hollow body for enclosing said mounting bracket, said hollow body having a lower portion and a rim portion, said lower portion adapted for receiving said down rod, and said rim portion adapted for receiving said mounting bracket;

a flange formed to extend from a terminal end of said rim portion of said canopy, said flange extending inward toward opposite sides of said terminal end of said rim portion of said canopy, and having at least two slots extending into opposite sides of said flange to provide openings for passing said tabs of said mounting arms of said mounting bracket;

said tab portion of said mounting bracket arms having two recesses, each of said two recesses formed into respective ones of said face portions of said tab portions;

two leaf springs mounted to opposite sides of said rim portion of said canopy, disposed on at least one interior wall thereof and angularly displaced from said two slots in said flange, said two leaf springs adapted for fitting within respective ones of said two recesses in said end face portions of said tabs, and wherein said two leaf springs engage with said two recesses to secure said canopy in a fixed position relative to said two mounting arms of said mounting bracket.

* * * * *